US005279528A

United States Patent [19]

Dalebout et al.

[11] Patent Number: 5,279,528

[45] Date of Patent: Jan. 18, 1994

[54] CUSHIONED DECK FOR TREADMILL

[75] Inventors: William T. Dalebout; Scott R. Watterson, both of Logan, Utah

[73] Assignee: Proform Fitness Products, Inc., Logan, Utah

[21] Appl. No.: 884,609

[22] Filed: May 15, 1992

Related U.S. Application Data

[63] Continuation of Ser. No. 659,512, Feb. 21, 1991, abandoned, which is a continuation-in-part of Ser. No. 479,835, Feb. 14, 1990, Pat. No. 5,088,729.

[51] Int. Cl.[5] ..... A63B 22/02

[52] U.S. Cl. ..... 482/54

[58] Field of Search ..... 482/26, 54, 70, 71, 482/111, 112, 113

[56] References Cited

U.S. PATENT DOCUMENTS

| | | | |
|---|---|---|---|
| 2,399,915 | 5/1946 | Drake . | |
| 3,628,654 | 12/1971 | Haracz | 272/69 X |
| 3,689,066 | 9/1972 | Hagen . | |
| 4,063,726 | 12/1977 | Wilson | 272/130 |
| 4,146,222 | 3/1979 | Hribar | 272/69 X |
| 4,167,938 | 9/1979 | Remih | 272/130 X |
| 4,350,336 | 9/1982 | Hanford . | |
| 4,423,864 | 1/1984 | Wiik | 272/69 X |
| 4,548,405 | 10/1985 | Lee et al. . | |
| 4,591,147 | 5/1986 | Smith et al. | 272/69 |
| 4,602,779 | 7/1986 | Ogden | 272/69 |
| 4,614,337 | 9/1986 | Schoneberger . | |
| 4,938,473 | 7/1990 | Lee et al. | 272/69 |
| 4,984,810 | 1/1991 | Stearns . | |

FOREIGN PATENT DOCUMENTS

| | | | |
|---|---|---|---|
| 0196877 | 10/1986 | European Pat. Off. | 272/69 |
| 403924 | 12/1990 | European Pat. Off. | 482/54 |
| 90111048.6 | 12/1990 | European Pat. Off. . | |
| 2616132 | 12/1988 | France | 482/54 |
| 8707895 | 12/1988 | France . | |
| 1347953 | 10/1987 | U.S.S.R. . | |

OTHER PUBLICATIONS

"Precor M9.3 Treadmill Brochure", Copyright 1990, Precor Incorporated, four (4) pages.

*Primary Examiner*—Robert Bahr

*Attorney, Agent, or Firm*—Trask, Britt & Rossa

[57] ABSTRACT

The present invention provides a resilient support for a treadmill deck by suspending the deck at its lateral edges on resilient elements supported by the side rails of the treadmill frame. In addition, the resilient elements may be of adjustable resiliency, such as inflatable bladders, or may be a combination of fixed and adjustably resilient portions. Also disclosed is the use of an adjustably resilient element between the treadmill frame and a supporting surface, and using such as arrangement to vary the inclination of the treadmill.

4 Claims, 4 Drawing Sheets

CUSHIONED DECK FOR TREADMILL

This application is a continuation of application Ser. No. 07/659,512, filed Feb. 21, 1991 now abandoned which in turn is a continuation-in-art of U.S. Pat. Application Ser. No. 07/479,835 filed Feb. 14, 1990 now U.S. Pat. No. 5,088,729.

BACKGROUND OF THE INVENTION

1. Field

This invention relates to exercise treadmills and, in particular, to treadmills having an endless belt riding over a tread base or deck on which the treadmill user walks, jogs, or runs.

2. State of the Art

Typical treadmills include a continuous or endless belt trained about a pair of rollers. The belt has an upper stretch which extends over a tread base or deck which supports a user thereon. The base or deck is secured to a frame which generally consists of a box formed of two longitudinal members and two cross members or braces secured to the longitudinal members proximate the front end and the rear end of the machine. The rollers are attached to and between the longitudinal frame members. A front roller may be driven by a motor. Typically, the user may change the speed of the continuous belt to increase the rate at which the exerciser must walk or run in order to maintain relative position on the treadmill. Typical treadmills, as above described, are relatively expensive to manufacture and less expensive but equally durable structure is disclosed and claimed in copending U.S. Pat. Application Ser. No. 07/479,835, filed Feb. 14, 1990, assigned to the assignee of the present invention and the disclosure of which is hereby incorporated herein by this reference.

All treadmills known to us, however, even the improved treadmill of the aforementioned application, suffer from a common deficiency which is the rigid and unyielding nature of the belt supporting structure, the tread base or deck. The deck rigidity necessary to support the user as he or she strides on the endless belt is, upon long use, uncomfortable to the user in the same manner as walking, jogging, or running on an asphalt or cement roadway or walkway for extended distances. Stated another way, striding on a conventional, rigid, and rigidly mounted treadmill base or deck may jar the joints and tendons of the user, particularly at higher speeds and over longer distances. This may be particularly detrimental to those using treadmills for rehabilitative purposes.

It would be desirable to have a more yielding supporting structure for the endless belt which could be inexpensively incorporated in existing treadmill designs with little or no modification thereof.

SUMMARY OF THE INVENTION

The present invention comprises a treadmill tread base or deck cushioning system in several preferred embodiments.

The first preferred embodiment of the invention comprises resilient cushioning means placed on the treadmill frame extensions or rails which extend longitudinally down the sides of the treadmill and to which the tread base or deck is, in the prior art, rigidly secured. The resilient cushioning means preferably comprises an elastomeric foam strip of the type such as is employed in foam weather-stripping and preferably extends along the top of the treadmill rails for substantially the full extent of each longitudinal edge of the treadmill deck. The cushioning strip is preferably adhesively bonded to both the rail below and the deck above it.

A second preferred embodiment of the invention comprises a cushioning means of variable resilience interposed between the treadmill frame and the tread deck or base. The variable resilience cushioning means of this embodiment preferably comprises air bladders which are placed on cushion supports inwardly of and adjacent to the rails proximate the forward or control console end of the tread deck or may be placed on the rails themselves. The air bladders may be of elongate or sausage-shaped configuration and secured to the cushion supports and are inflated by means of hoses which run to a common "Tee" connection which itself leads to an inflation device such as a rubber bulb or a small air pump. Means for releasing air from the bladders is also provided to let the user adjust or fine tune the resiliency of the deck to individual preference. While it is preferred that the air bladders be used in conjunction with the aforementioned resilient cushioning strips on the rails, the invention is not so limited, and an air bladder or bladders, according to the preferred embodiments, may be used as the sole means to cushion a treadmill deck.

While less preferred due to the component weight and expense, other resilient means may also be used to cushion the treadmill deck to the "feel" of the user. For example, coil or belleville springs may be employed in addition to or in lieu of the cushion strips or air bladders. Rubber, coil, hydraulic, or air springs might be incorporated into or added to an incline adjustment and/or treadmill support structure at the forward end of the treadmill, either between the support and the rails or as part of the support to, for example, raise the wheels off of the floor and to thereby also provide resiliency or shock absorption to the treadmill user. Finally, a treadmill deck having a resilient insert therein may also be employed.

DETAILED DESCRIPTION OF THE PREFERRED EMBODIMENTS

Figure 1:
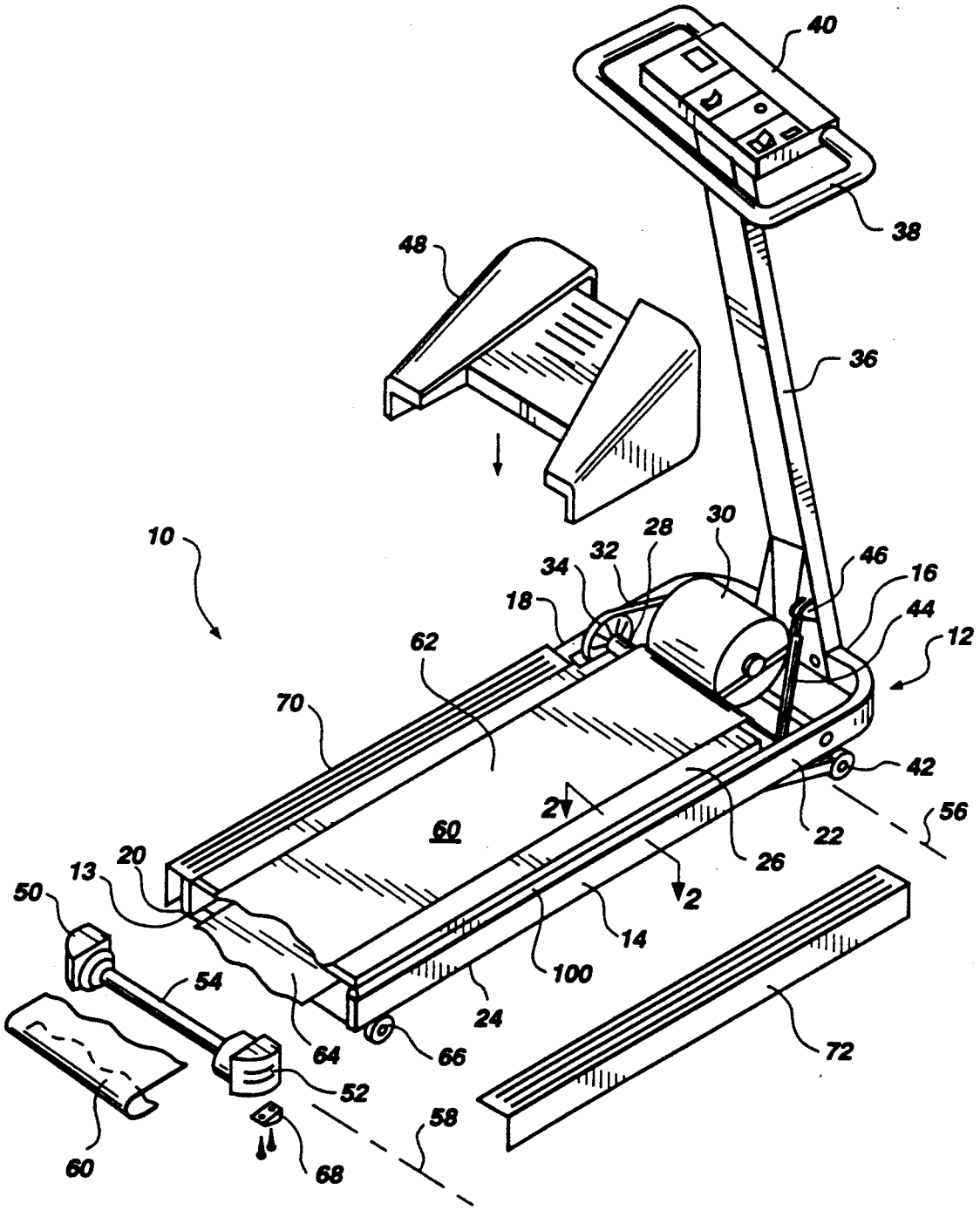
FIG. 1 is an exploded perspective, partial sectional view of a treadmill according to a first preferred embodiment of the present invention.

The treadmill of FIG. 1 is generally denominated by the number 10. It has a frame 12 which includes a left extension or rail 13 and a right extension or rail 14. The left and right extensions are each spaced apart from the other in substantial alignment as illustrated. A transverse member 16 is interconnected between the left extension 13 and the right extension 14 to form a "U"-shaped frame. The left extension 13 has a front end 18 and a rear end 20. Similarly, the right extension 14 has a front end 22 and a rear end 24. A tread base 26 is attached to the frame 12 to extend between the left extension 13 and the right extension 14 to support an exercising user thereon. A drive roller 28 is rotatably mounted in between the left extension 13 and the right extension 14 between the tread base 26 and the transverse member 16. As can be seen, the drive roller 28 is positioned immediately forward of the tread base 26.

Treadmill 10 includes drive means which is secured to the frame 12 and connected to rotate the drive roller 28. The drive means illustrated in FIG. 1 includes a motor 30 interconnected by a pulley belt 32 to a pulley 34 secured to the drive roller 28. Means may be provided to vary the speed of the pulley belt 32 by selecting a motor 30 which is a variable speed DC motor or by providing structure to mechanically vary the speed of the pulley belt 32.

The treadmill 10 of FIG. 1 also includes an upstanding post 36 with a handle 38 and console 40 connected thereto. The treadmill 10 also includes forward wheel structure 42 which is interconnected to an air cylinder 44. The cylinder 44 is connected to a bracket 46. The cylinder 44 is operable by a lever (unnumbered) in the console 40 to urge the wheel structure 42 toward and away from the frame 12 to in turn adjust the angle of inclination of the treadmill 10. As known by adjusting the angle of inclination, the user may adjust the degree of difficulty of the exercises being performed on the treadmill 10. One suitable adjustment structure including such a cylinder is disclosed and examined in U.S. Pat. No. 4,913,396, assigned to Weslo, Inc. of Logan, Utah.

In FIG. 1, a housing 48 is shown in an exploded relationship with respect to the frame 12. More particularly, the housing 48 is configured to be positioned over the motor 30, cylinder 44, and the associated structure positioned at one end of of the tread base 26 to prevent accidental contact with moving parts and to minimize the number of surfaces and apertures into which a user might step or slip during use.

The treadmill 10 of FIG. 1 has a left roller bracket or end cap 50 and right roller bracket or end cap 52 which are secured to their respective left extension 13 and right extension 14 proximate the rear ends 20 and 24, respectively. A tail roller 54 is adapted to and between the left roller bracket 50 and the right roller bracket 52 in transverse alignment with the drive roller 28. To be in transverse alignment, the axis 56 of the drive roller 28 is substantially parallel to the axis 58 of the tail roller 54. The tail roller 54 spaces the left extension 13 from the right extension 14 and secures the left extension to the right extension 14. That is, the tail roller 54, along with the left roller bracket 50 and right roller bracket 52, also act as a transverse member with the frame.

As may be further observed in FIG. 1, the treadmill 10 also includes an endless belt 60 which is trained about the drive roller 28 and the tail roller 54 over the top of the tread base 26. The user may walk, jog, or run on the endless belt 60 and thereby exercise with the weight of the user being supported by the tread base or deck 26. The endless belt 60 has an upper stretch 62 which is positioned on top of the tread base or deck 26 and a lower stretch 64 which extends between the drive roller 28 and tail roller 54 under tread base or deck 26. A rear foot 66 may be provided proximate the rear end 20 of the left extension 13 and the rear end 24 of the right extension 14 to support the frame 12 upon a surface. Alternately, a support foot 68 may be bolted to or unitarily formed to be part of the right roller bracket 52 and a similar foot bolted to or formed to be part of the left roller bracket 50 to support the frame 12 and in turn the treadmill 10 on a support surface selected by the user.

Figure 2:
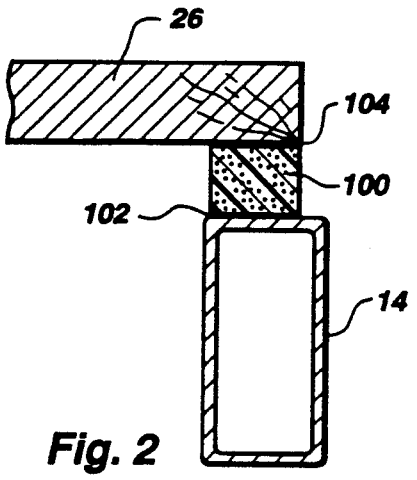
FIG. 2 is a section taken across section lines 2—2 of FIG. 1.

To this point, the structure of treadmill 10 is known in the art as augmented by the disclosure of the previously referenced and incorporated U.S. Pat. Application Ser. No. 07/479,835. However, referring again to side rails or extensions 13 and 14, it will be observed that each is surmounted by a resilient cushioning means 100. FIG. 2 shows rail 14 with cushioning means 100 thereon and the right-hand edge of tread base or deck 26 resting on a cushioning means 100. Similarly, rail 13 has a cushioning means 100 supported thereon, and the left-hand side of deck 26 rests on the left-hand cushioning means 100. Each cushioning means 100 in this embodiment is preferably a strip of elastomeric material and may comprise a foam material such as the type of foam used in weatherstripping. The durometer of the foam may be selected to provide the desired degree of resiliency or "cushion" to the treadmill user and the type of use (walking, jogging, or running) that the user intends. To that end, the treadmill may be sold with different cushioning options or different cushioning strips so that the user may change that which is installed on the treadmill should that be perceived as too hard or too soft.

Cushioning strip 100 preferably extends substantially the entire length of each edge of tread base or deck 26 and, in the embodiment of FIGS. 1 and 1, is secured preferably by adhesive bonding to both the tops of rails 13 and 14 and the lower surface of the lateral edges of tread base or deck 26, as shown respectively, at 102 and 104 of FIG. 2. The bonding or securement process may be facilitated by the use of foam stripping which has preapplied adhesive to both the top and bottom surfaces or by the use of double-sided adhesive tape between the rail and the strip and the strip and the deck. It is contemplated that cushion strips of different durometer rating may be used along different portions of the rail so that the deck is immediately adjacent the control console 40 might be resiliently supported to one degree of cushioning and that farther to the rear to a greater or lesser degree. Thus, the user may place himself or herself at different positions on the upper stretch 62 of belt 60 for a different "feel" or for greater or lesser comfort. Moreover, the degree of resiliency or cushioning may be varied not only by selection of different durometer materials but also by varying the cross-sectional depth and width of the strips 100.

In lieu of the use of elastomeric or foam materials for cushioning means 100 in the embodiment of FIGS. 1 and 2, it is contemplated that coil, leaf, or other springs may be employed on or in association with rails 13 and 14 to support tread base or deck 26. The cushioning means might be mounted inboard of rails 13 and 14 so as to avoid increasing the height of tread base or deck 26. To such an end, the cushioning means might be mounted on supports of "L" or box cross section which are secured to the inner faces of the rails 13 and 14.

The treadmill of FIGS. 1 and 2 is indistinguishable in appearance than conventional treadmills, as left and right safety steps 70 and 72 are secured to left and right rails or extensions 13 and 14, respectively, according to current practice, thus, hiding cushioning means 100 from view. If cushion strips 100 are mounted as shown in FIG. 1, the mounting position (elevation) of rollers 28 and 54 will be raised by a height substantially equivalent to that of the cushioning means so that the upper stretch 62 will be substantially parallel to the top of tread base or deck 26 as in conventional treadmills.

Figure 4:
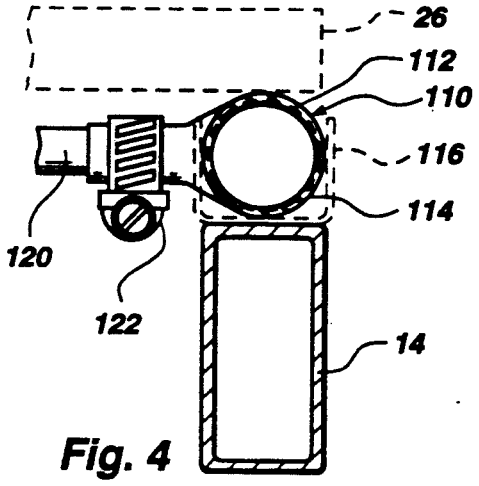
FIG. 4 is a section taken across section lines 4—4 of FIG. 3.
Figure 3:
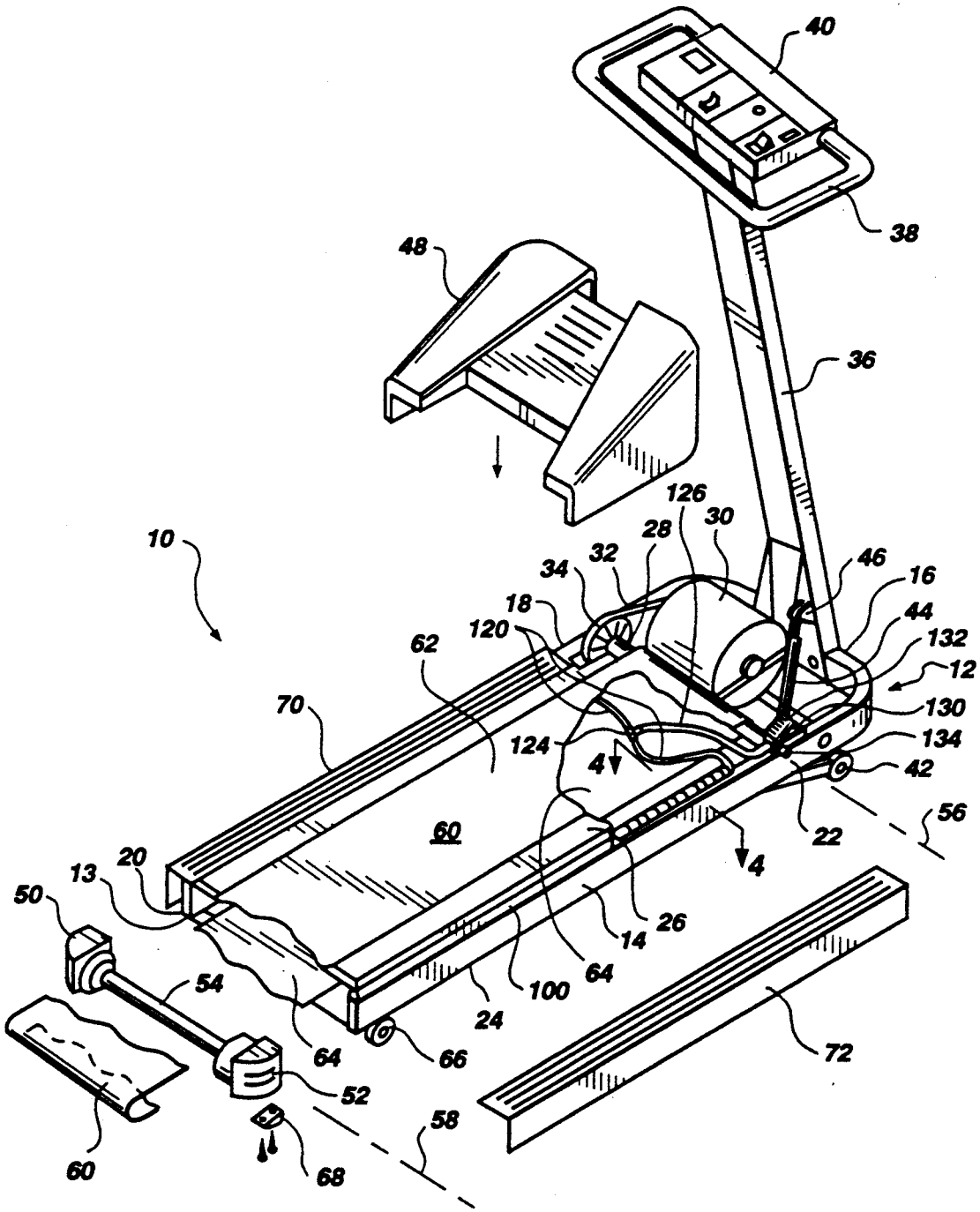
FIG. 3 is an exploded, perspective, partial sectional view of a treadmill according to a second preferred embodiment of the present invention.

In the second preferred embodiment of the cushion depicted in FIGS. 3 and 4, cushioning means 100 on treadmill 110 is supplemented by a second, variable cushioning means which, in the embodiment shown, comprises pressurized air bladders 110 mounted on rails 13 and 14. Bladders 110 may comprise any suitable material, such as urethane compounds, which are air-tight and self-supporting under pressure and the weight of the treadmill user. Alternatively, bladders 110 may comprise latex or other rubber compounds with internal reinforcement 112 (wire, mesh, fabric, etc.) or external reinforcement 114 (tape, fabric, etc.) to prevent bladder rupture under the stress of the user's weight and motion. The external reinforcement may even comprise a "U"-shaped channel 116 as shown on top of rail 14 in FIG. 4, channel 116 also providing positive underlying support for tread base or deck 26 in the unlikely event of bladder rupture so as to prevent damage to the deck 26.

A bladder 110 is located, in the embodiment of FIGS. 3 and 4, on each rail 13 and 14 immediately to the rear of drive roller 28. Farther to the rear, deck 26 is preferably supported by a cushion strip 100 such as earlier, previously described, although it is contemplated that the rear edges of the deck 26 may be securely mounted to box beams or other supports on top of rails 13 and 14, the front end of deck 26 thus being cantilevered over the portion of the rails whereon air bladders 110 are mounted. Such an alternative provides resiliency from the structure of the deck 26 itself in the manner of a diving board, as well as adjustability thereof and damping via air bladders 110.

Bladders 110 are inflated via rubber tubing or hose 120 which is secured to the bladder inlet openings via any suitable means, an automotive-style hose clamp 122 being shown in FIG. 4. Hoses 120 from right and left bladders 110 are preferably joined at "Tee" 124 by other clamps 122, the base of the "Tee" 124 being in communication with feed hose or tubing 126 which is preferably of the same material as tubing 120. Feed hose 126 leads to air pump 130 which may comprise a squeeze bulb 130 such as is used to inflate blood pressure cuffs. This bulb may be mounted on console 40 or may, as shown in FIG. 3, be mounted on or adjacent to rail 14 inside a hinged pedal assembly 132 so that the foot of the user may be employed to operate the bulb. It is also necessary to have a means to bleed air out of the system to adjust the cushioning effect, and such can be a screw-type bleed valve (again, as used with a blood pressure cuff) or a spring-loaded relief valve secured to relief tab 134 on pedal assembly 132 so that a touch by the user's foot will bleed off some pressure from the system.

The second preferred embodiment, unlike the first, thus permits infinite adjustment of the resiliency or cushioning effect provided the treadmill user within the range of inflation pressures available for bladders 110. Adjustment may be merely to the feel of the user or may be to calibrated, such as by the use of a pressure gauge or transducer with a dial or electronic readout, so that the user may select, for example, a resiliency or cushioning approximately that of earth, grass, etc.

Figure 6:
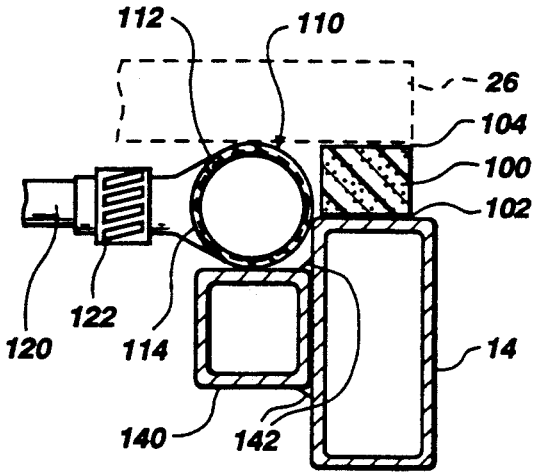
FIG. 6 is a section taken across section lines 6—6 of FIG. 5.
Figure 5:
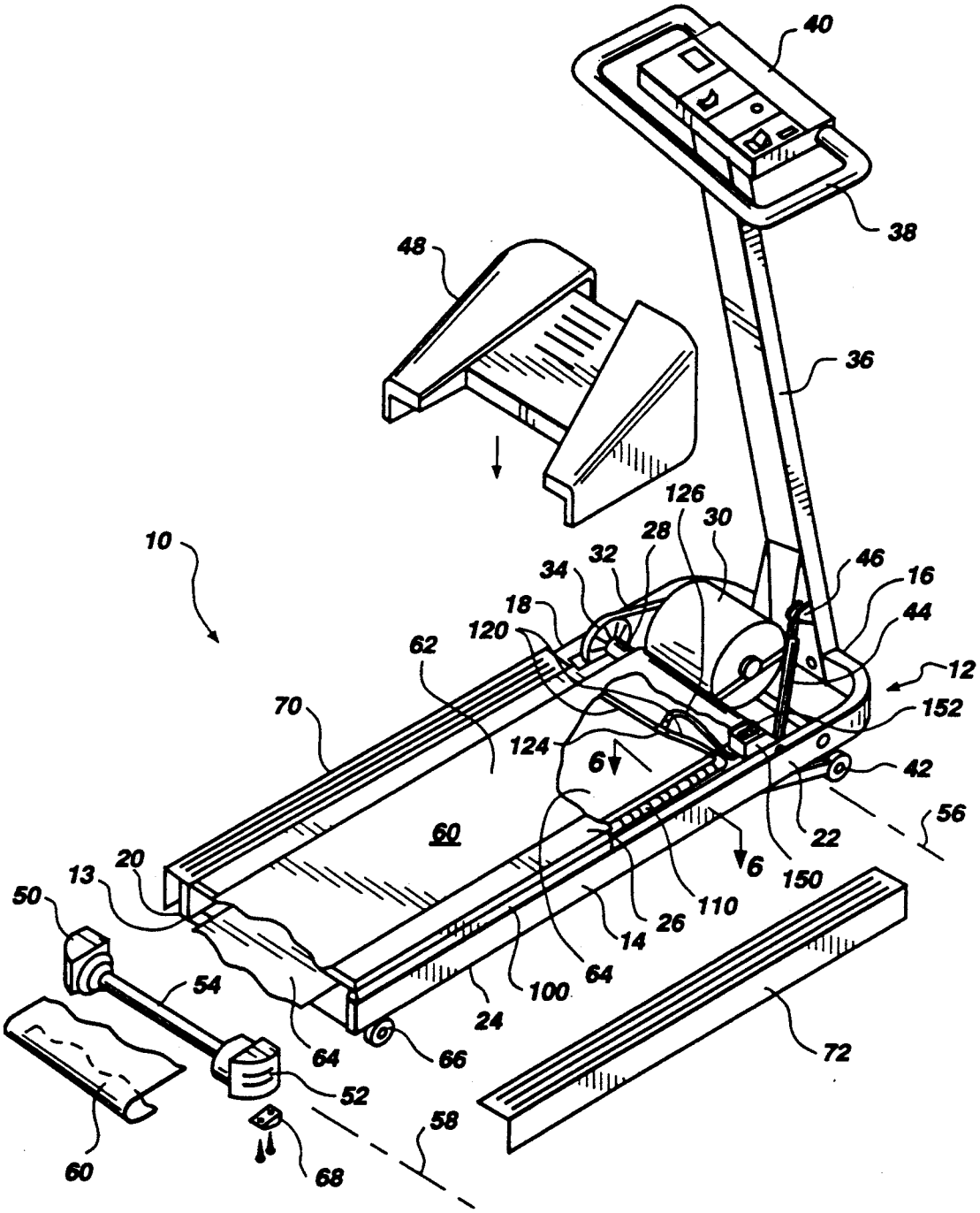
FIG. 5 is an exploded, perspective, partial sectional view of a treadmill according to a modification of the second preferred embodiment of the present invention.

A variation of the second preferred embodiment of the invention, depicted in FIGS. 5 and 6, is similar to that of FIGS. 3 and 4 in that both cushioning means 100 and variable cushioning means 110 are employed with treadmill 10, but in this embodiment, cushioning means 100 is coextensive with variable cushioning means 110 along at least the forward ends of rails 13 and 14. Air bladders 110 are mounted inboard of rails 13 and 14 on cushion supports comprising box beams 140 or other suitable supports, such as "L"-beams, welded at 142 or otherwise secured to the inside of rails 13 and 14. Cushion strips 100 run on top of rails 13 and 14, as in the first preferred embodiment, for substantially the entire length of the side edges of deck 26 and are preferably of a softer compound (lower durometer rating) than if used alone as in the embodiment of FIGS. 1 and 2, thus, providing a basic resiliency which is augmented by bladders 110 over a wide range.

The air bladders 110 of FIG. 5 are inflated via hose or tubing 120, "Tee" 124, and feed hose or tubing 126 by a source of pressurized air which may be a manual pump (bulb) as hereto shown and described with respect to FIG. 3, or an electric air pump 150, as shown in FIG. 5, pump 150 having a rocker switch 152 which activates pump 150 to inflate the system when pressed in one direction and activates a spring-biased relief valve when pressed in the other direction to release air from the bladder system.

While the bladders 110 in the second embodiment have been depicted as being hollow, it is also contemplated that they may be filled with an open-cell foam to provide an internal cushioning strip of basic resiliency which may then be modified by the bladder system internal air pressure. With such a design, full length bladders could be employed in lieu of full-length cushion strips 100 in the embodiment of FIGS. 1 and 2.

While two preferred embodiments of the invention have been previously described, other alternative embodiments are also possible, as shown in FIGS. 7 through 10.

Figure 7:
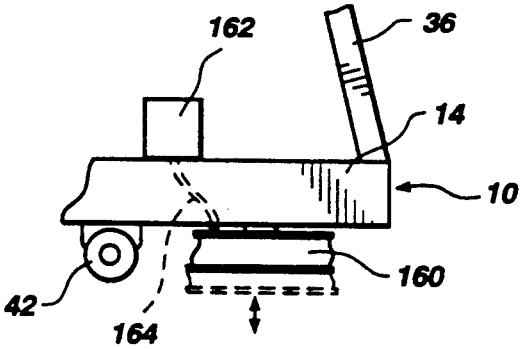
FIGS. 7 through 10 schematically depict further alternative embodiments of the present invention.

FIG. 7 depicts treadmill 10 having an air spring 160, such as is commercially available from the Goodyear Tire and Rubber Company, secured to the bottom of frame 12 and inflatable with air pump 162 via hose or tubing 164. In such an arrangement, treadmill 10 may be lifted off of wheel structure 42 to effect an inclination of the unit for the user, the nature of the air spring also providing resiliency or cushioning to the user.

Figure 8:
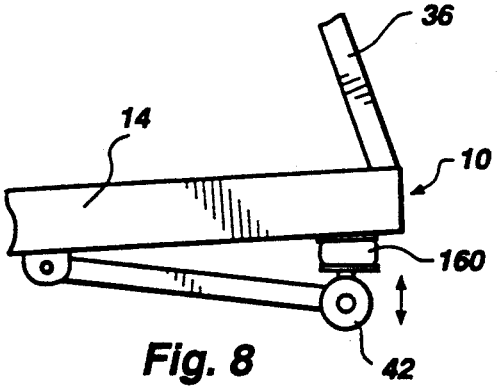

In the embodiment of FIG. 8, an air spring 160 is again employed but in conjunction with a pivotally mounted, articulated wheel structure 42 as is conventionally used with treadmills. As with the embodiment of FIG. 7, air spring 160 is employed to both elevate the front of the treadmill and cushion the shock of the user's motion thereon. The air spring may be inflated by any means previously described herein or others known in the art.

Figure 9:
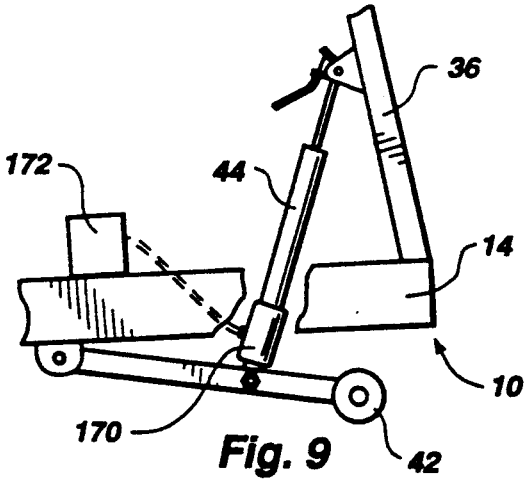

With the embodiments of FIGS. 8 and 9, cylinder 44, commonly a pressurized gas cylinder used for treadmill inclination adjustment in the prior art, may be eliminated. If it is desired to maintain separate inclination and cushioning or resiliency control, however, the cylinder 44 may be combined with a shock absorption means 170, as shown in FIG. 9. Shock absorption means 170 may comprise an air spring, a hydraulic system such as a motorcycle shock absorber or other dashpot-type system, a sealed or variable pressure bladder, either with an empty interior or filled with a foam, a soft rubber pad or bushing, or springs. As implied, the cushioning system of FIG. 9 may be of fixed or variable resiliency and if the latter, a resiliency control means, such as an air pump 172, is employed.

Figure 10:
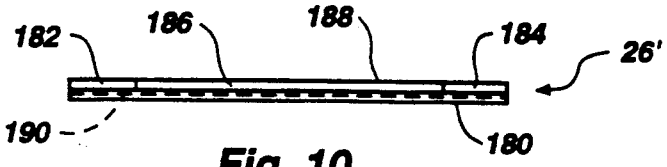

The embodiment of FIG. 10 depicts a cross section of an alternative tread base or deck 26' which may be employed in lieu of base 26 in existing treadmills to provide a cushioning effect. Deck 26' comprises a rigid lower panel 180 having, optionally, rigid side panels 182 and 184 mounted thereon to reduce flex in the deck. Between side panels 182 and 184, resilient insert 186 rests on lower panel 180 and is covered with a wear-resistant, thin but rigid, low-friction membrane or cover 188, such as plastic, metal, fiberglass, or other such materials as known in the art. Alternatively, cover 188 might be bonded as a surface to resilient insert 186 at the time of manufacture thereof. If additional structural support is required to prevent deck 26 from bowing in the middle, reinforcing cross members 190 may be utilized in or under lower panel 180. The deck 26' of FIG. 10 is secured to the rails 13 and 14 of an existing treadmill after the deck supplied with it has been removed, thus, providing a degree of cushioning to the user. While the resiliency provided by deck 26' is generally less than that furnished by the preferred embodiments, it is nonetheless far superior to that of conventional plywood, particle board, or other rigid deck construction and is a less costly alternative to purchasing a new treadmill.

The present invention, while described in terms of a plurality of preferred and alternative embodiments, is not so limited, and one of ordinary skill in the art will recognize that many additions, deletions, and modifications to the embodiments disclosed herein may be made without departing from the spirit and scope of the invention as defined by the following claims.

What is claimed is:

1. An apparatus for cushioning the impact of a user's movement on a treadmill, comprising:

an elongated, substantially rigid treadmill frame having two ends and supporting a movable treadmill belt shown; and at least one cushioning element including a bladder selectively inflatable between differing degress of resiliency by air pump and valve means supported on said treadmill frame and controllable by said user while positioned on said treadmill, said bladder interposed between said elongated, substantially rigid frame proximate one end thereof and a supporting floor surface on which said treadmill is disposed.

2. The apparatus of claim 1, wherein said at least one selectively adjustable cushioning element is variably inflatable.

3. The apparatus of claim 2, wherein said at least one variably inflatable element further comprises means for variation of the inclination of said treadmill.

4. The apparatus of claim 2, further including a lever arm disposed under and having one end pivotally secured to said frame, said variably inflatable element being interposed between said frame and other other end of said lever arm.

* * * * *

UNITED STATES PATENT AND TRADEMARK OFFICE

CERTIFICATE OF CORRECTION

PATENT NO. : 5,279,528

DATED : Jan. 18, 1994

INVENTOR(S) : Dalebout et al.

It is certified that error appears in the above-identified patent and that said Letters Patent is hereby corrected as shown below:

In the Abstract, line 9, after "such" change "as" to --an--;

In Column 1, line 6, change "art" to --part--;

In Column 3, line 40, delete "of" (second occurrence);

In Column 3, line 57, change "act" to --acts--;

In Column 4, line 33, change "1" (second occurrence) to --2--;

In Column 4, line 44, after "deck" delete "is";

In Column 5, line 9, change "treadmill 110" to --treadmill 10--;

In Column 5, line 28, delete "earlier,";

In Column 5, line 64, delete "to";

In Column 8, line 10, change "shown" to --thereon--;

In Column 8, line 12, change "degress" to --degrees--; and

In Column 8, line 29, delete "other" (first occurrence) and insert --the-- therefor.

Signed and Sealed this

Fifth Day of July, 1994

*Attest:*

Bruce Lehman

BRUCE LEHMAN

*Attesting Officer*

*Commissioner of Patents and Trademarks*